US006270541B1

(12) United States Patent
Basu et al.

(10) Patent No.: US 6,270,541 B1
(45) Date of Patent: Aug. 7, 2001

(54) DIESEL FUEL COMPOSITION

(75) Inventors: Arunabha Basu, Naperville; Theodore H. Fleisch, Warrenville; Christopher I. McCarthy, Naperville, all of IL (US); Svend-Erik Mikkelsen, Gentofte (DK); Carl A. Udovich, Joliet, IL (US)

(73) Assignee: BP Corporation North America Inc., Chicago, IL (US)

( * ) Notice: Subject to any disclaimer, the term of this patent is extended or adjusted under 35 U.S.C. 154(b) by 0 days.

(21) Appl. No.: 08/463,939

(22) Filed: Jun. 5, 1995

Related U.S. Application Data

(63) Continuation of application No. 08/289,933, filed on Aug. 12, 1994, now abandoned.

(51) Int. Cl.[7] ..... C10L 1/18
(52) U.S. Cl. ..... 44/448; 44/302; 44/451
(58) Field of Search ..... 44/448, 449, 451, 44/302

(56) References Cited

U.S. PATENT DOCUMENTS

| | | | | |
|---|---|---|---|---|
| 2,708,922 | * | 5/1955 | Neely | 44/448 |
| 3,846,088 | * | 11/1974 | Brown et al. | 44/449 |
| 4,341,069 | * | 7/1982 | Bell et al. | 60/39.02 |
| 4,422,412 | * | 12/1983 | Norton | 123/1 A |
| 4,518,395 | * | 5/1985 | Petronella | 44/451 |
| 4,603,662 | * | 8/1986 | Norton et al. | 44/446 |
| 4,682,984 | * | 7/1987 | Epler | 44/448 |
| 4,892,561 | * | 1/1990 | Levine | 44/414 |
| 5,177,114 | * | 1/1993 | Van Dijk | 252/373 |

FOREIGN PATENT DOCUMENTS

654470 * 12/1937 (DE) .

* cited by examiner

*Primary Examiner*—Margaret Medley
(74) *Attorney, Agent, or Firm*—Thomas A. Yassen

(57) ABSTRACT

A diesel fuel composition comprising from about 70 to about 95 weight percent of dimethyl ether, up to about 20 weight percent of methanol, and from about 0.1 to about 20 weight percent of water is disclosed.

12 Claims, No Drawings

DIESEL FUEL COMPOSITION

This is a continuation of application Ser. No. 08/289,933, filed Aug. 12, 1994 now abandon.

BACKGROUND OF THE INVENTION

1. Field of the Invention

This invention relates generally to a diesel fuel composition and more particularly concerns a diesel fuel composition comprising dimethyl ether, methanol and water.

2. Description of the Prior Art

As alternatives to conventional hydrocarbon diesel fuel produced by refining petroleum, other liquid fuels obtained by the conversion of methane or coal have been under consideration since the 1920's. Methanol has been proposed as one such alternative fuel for internal combustion engines. Methanol is usually manufactured from carbon monoxide and hydrogen, which have historically been obtained in large volume from either natural gas or coal. Carbon monoxide can also be obtained from almost any carbon-containing substance, including agricultural and forest products and many waste materials. The large supply and wide distribution of raw materials for manufacturing methanol is responsible to a large degree for its growing use as a fuel for internal combustion engines. However, methanol has a very low heating or BTU value. Thus, the performance of an internal combustion engine declines considerably when methanol is employed as the fuel.

By contrast, relative to methanol, dimethyl either has a higher BTU value and is nontoxic. In addition, dimethyl ether is a clean-burning fuel whose combustion gases are essentially free of solid particles. Numerous methods have been disclosed for the production of dimethyl ether in combination with methanol and water from synthesis gas obtained from various sources, such as natural gas, coal or essentially any carbon-containing substance. Bell et al., U.S. Pat. No. 4,341,069; Van Dijk et al., U.S. Pat. No. 5,177,114; and published European Patent Applications Nos. 0324475 and 0409086 A1 are examples of such disclosures. In particular, European Patent Applications Nos. 0324475 and 0409086 A1 disclose how process conditions can be controlled in one such method in order to produce mixtures of dimethyl ether and methanol having a wide range of mole ratios of dimethyl ether to methanol.

In numerous methods for the manufacture of dimethyl ether, dimethyl ether is produced in a product mixture that also contains methanol and/or water. Furthermore, removal of methanol and water from dimethyl ether in such a product mixture would require additional processing steps. Thus, it would be highly desirable to be able to employ mixtures of dimethyl ether, methanol and water—or, in other words, crude or unpurified dimethyl ether—directly as diesel fuels in order to avoid the aforesaid additional processing steps associated with purifying crude dimethyl ether and ideally so that process conditions could be employed in order to produce such mixtures directly from synthesis gas. In that way, it would be possible to avoid or at least minimize the need for additional processing steps, such as purification steps, and still produce a highly effective and economical alternative diesel fuel.

There have also been a number of disclosures of diesel fuels that comprise either a mixture of dimethyl ether and methanol, a mixture of dimethyl ether, methanol and water, or a mixture of dimethyl ether and a cetane number-improving additive. For example, German Patent No. 654,470 (1937) discloses mixtures of dimethylether and methanol containing from 5 percent to 45 percent of methanol (and hence from 55 percent to 95 percent of dimethyl ether) for use as fuels for an internal combustion engine, which permits the relatively high heating value of dimethyl ether to be utilized while avoiding an excessive penalty due to the tendency of dimethyl ether to knock in a spark ignition engine.

Furthermore, Norton, U.S. Pat. No. 4,422,412, discloses a diesel fuel composition that contains a mixture of dimethyl ether, methanol and water containing "up to about 50%, e.g., about 5 to 30%" of dimethyl ether. This mixture is produced by the catalytic conversion of methanol to dimethyl ether and water in a reactor whose outlet is in communication with a cylinder of an internal combustion engine.

In addition, Norton et al., U.S. Pat. No. 4,603,662, discloses a diesel fuel composition that contains a mixture of at least one ether and at least one alcohol, and optionally additional constituents such as water or cetane improvers, which contain "from 5 to 80%, more usually from 5 to 20% by volume of ethers in the fuel." The patent discloses that a fuel containing a combination of dimethyl ether and methanol is a particularly convenient fuel and specifically illustrates this combination with blends containing: (a) 95 percent of methanol and 5 percent of dimethyl ether by volume in Examples 1 and 3; and (b) 78 percent of methanol and 20 percent of dimethyl ether in Example 5.1. The patent also contains the following specific illustrations of blends of alcohols and ethers that contain at least 50 percent of the ethers: (a) 80 percent of isoamyl ether and 20 percent of methanol in Example 5.9; (b) 60 percent of di-n-propyl ether, and 40 percent of methanol in Example 6.2; and (c) 60 percent of di-n-butyl ether and 40 percent of methanol in Example 6.5.

Levine, U.S. Pat. No. 4,892,561, discloses a first diesel fuel composition that contains 95–99.9 percent by weight of dimethyl ether and 0.1–5 percent by weight of a cetane number-improving additive. This patent also discloses a second diesel fuel composition that contains at least 50 percent by weight of the aforesaid first diesel fuel and the remainder conventional hydrocarbon diesel fuel.

However, thus far there has not been a disclosure of the compositions of mixtures of dimethyl ether, methanol and water that contain the balance of concentration levels of dimethyl ether, methanol and water that is necessary for the resulting diesel fuel to afford both environmental benefits and good ignition characteristics, that can be produced economically without the need for costly purification steps and that can be maintained as a stable single liquid phase both in use and during storage.

OBJECTS OF THE INVENTION

It is therefore a general object of the present invention to provide an improved alternative diesel fuel composition which overcomes the aforesaid problems and affords the aforesaid benefits.

More specifically, it is an object of the present invention to provide an improved alternative diesel fuel composition that has a high BTU value.

It is another object of the present invention to provide an improved alternative diesel fuel composition that is a clean burning material whose overall emissions are lower and whose combustion gases are essentially free of solid particles.

It is a further object of the present invention to provide an improved alternative diesel fuel composition that affords good ignition characteristics.

It is another object of the present invention to provide an improved alternative diesel fuel composition that can be produced economically without the need for costly purification steps.

It is an additional object of the present invention to provide an improved alternative diesel fuel composition that is maintained in a stable single liquid phase both in use and during storage.

Other objects and advantages of the present invention will become apparent upon reading the following detailed description and appended claims.

SUMMARY OF THE INVENTION

These objects are achieved by an improved diesel fuel composition that comprises from about 70 to about 95 weight percent of dimethyl ether, from about 0.1 to about 20 weight percent of water, and up to about 20 weight percent of methanol, wherein the lowest concentration of methanol in weight percent (min. meth. conc.) that is permitted in the diesel fuel composition containing a given water concentration in weight percent (water conc.) is defined by the relationship, $$0 \leqq \text{min. meth. conc.} \geqq 0.5\ (\text{water conc.}) - 2.6,$$

and the largest concentration of methanol in weight percent (max. meth. conc.) that is permitted in the diesel fuel composition containing a given water concentration in weight percent (water conc.) is defined by the relationship, $$\text{max. meth. conc.} \leqq 20 - 0.6\ (\text{water conc.}).$$

DETAILED DESCRIPTION

The composition of the present invention is a diesel fuel composition that comprises a mixture of dimethyl ether, methanol and water. Dimethyl ether is present in the alternative diesel fuel composition of the present invention at a level of from about 70 weight percent, preferably from about 85 weight percent, to about 95 weight percent, preferably to about 93 weight percent. If the alternative diesel fuel composition of the present invention contains less than about 70 weight percent of dimethyl ether, the problems of poor ignition characteristics and of separation of the diesel fuel into two liquid phases result and prohibit the composition from being used effectively as a diesel fuel.

Water is present in the alternative diesel fuel composition of the present invention at a level of from about 0.1 weight percent, preferably from about 1 weight percent, more preferably from about 2 weight percent, up to about 20 weight percent, preferably up to about 10 weight percent. If the composition of the present invention contains more than about 5.2 weight percent of water in admixture with dimethyl ether alone, it will separate to form two liquid phases unless methanol is also present.

Within limits to be described hereinbelow, the presence of certain amounts of methanol in the mixture of dimethyl ether and water stabilizes the mixture against separation into two liquid phases. The amount of methanol that is necessary to provide this stabilization increases as the concentration of water in the mixture with dimethyl ether increases. However, if too much methanol is present in the mixture containing a particular concentration of water, the ignition characteristics of the mixture are adversely affected. Thus, for a mixture of dimethyl ether with a given concentration of water, the concentration of methanol in such mixture must be at least a certain minimum level in order to prevent phase separation and must be below a certain maximum level in order to avoid poor ignition characteristics.

The specific maximum and minimum concentrations of methanol in the mixture depend on and vary with the particular water concentration in the mixture. The minimum concentration of methanol in weight percent (min. meth. conc.) in the diesel fuel depends on the water concentration therein in weight percent (water conc.) containing a given water concentration and is determined by the approximate relationship $$0 \leqq \text{min. meth. conc.} \geqq 0.5\ (\text{water conc.}) - 2.6.$$

The maximum concentration of methanol in weight percent (max. meth. conc.) in the diesel fuel containing a given water concentration is determined by the approximate relationship $$\text{max. meth. conc.} \leqq 20 - 0.6\ (\text{water conc.}).$$

Both of these approximate relationships were determined empirically based on actual measurements of ignition characteristics and phase separations using a significant number of different mixtures of dimethyl ether, methanol and water.

As these relationships indicate, it is not necessary that methanol is present in the alternative diesel fuel composition of the present invention unless the fuel composition contains at least 5.2 weight percent of water. In addition, the maximum concentration of methanol that can be present in the alternative diesel fuel composition of the present invention under any circumstance is 20 weight percent. Furthermore, when the alternative diesel fuel composition of the present invention contains 20 weight percent of water, the fuel composition must also contain at least 7.4 weight percent of methanol in order to prevent phase separation but must not contain more than 8 weight percent of methanol, otherwise poor ignition characteristics result. This range of effective methanol concentrations is so narrow that for all practical purposes, the upper limit of the concentration of water that may be present in the alternative diesel fuel composition of the present invention is 20 weight percent.

In another preferred embodiment, if it is desirable to improve the ignition characteristics of the alternative diesel fuel composition of this invention, any convenient conventional cetane number-improving additive can be added to the diesel fuel composition in cetane number-improving amounts. Examples of suitable cetane number-improving additives include inorganic peroxides such as hydrogen peroxide, organic peroxides such as ethyl t-butyl peroxide and di-t-butylperoxide, alkyl nitrates such as ethyl hexyl nitrate, amyl nitrate, and nitromethane. More specifically, the cetane number-improving additive is employed at a concentration in the diesel fuel composition in the range of preferably from about 0.01, more preferably from about 0.05, preferably to about 3 weight percent, more preferably to about 1 weight percent.

In an additional preferred embodiment, the alternative diesel fuel composition of this invention can additionally comprise up to 50 weight percent of either a conventional hydrocarbon diesel fuel or a biodiesel fuel derived from plants and vegetables.

The present invention will be more clearly understood from the following specific example. A diesel fuel composition containing 94 weight percent of dimethyl ether, 3 weight percent of water, and 3 weight percent of methanol was tested in a Navistar T 444E diesel engine having a 90 degree V-8 with a displacement of 444 cubic inches, a bore diameter of 4.11 inches, and a stroke of 4.18 inches. The diesel engine was a turbocharger equipped with an air-to-air intercooler and an electronically controlled direct injection fuel system and was fitted with an exhaust gas recirculation system. For this testing, since more DME has to be injected to achieve the same power output as conventional hydrocarbon diesel fuel, slightly oversized injectors were used. In addition, due to the higher volatility of the dimethyl ether-containing composition tested, a modified feed pump was employed in order to prevent fuel cavitation in the injector. The engine test was performed using an 8-mode steady-state test cycle that simulates the U.S. EPA transient test cycle. The following exhaust emissions were measured: hydrocarbons, carbon monoxide, nitrogen oxides, smoke and particulates.

Test results indicate that the consumption of the dimethyl ether-containing composition was substantially equal to that of conventional diesel fuel when the emission level was 5 gm/bhp-hr of nitrogen oxides and was significantly lower than that of conventional diesel fuel when the emission level was less than 3.64 gm/bhp-hr of nitrogen oxides. The level of nitrogen oxides emissions was only about 1.7 gm/bhp-hr which is a significant improvement over the level of nitrogen oxides emissions of pure dimethyl ether alone. The soot content of the emissions was only about 0.03 gm/bhp hr, and the level of hydrocarbon emissions was about 0.3 gm/bhp-hr which is only slightly above that of pure dimethyl ether alone. The combination of (1) the sum of the levels of nitrogen oxide and hydrocarbon emissions of about 2.1 gm/bhp-hr, and (2) the level of particulates in the emissions of about 0.034 gm/bhp-hr measured in this test is already within the upper limits therefor of 2.5 gm/bhp-hr and 0.05 gm/bhp-hr, respectively, mandated by the California ULEV, which will not go into effect until 1998.

From the above description, it is apparent that the objects of the present invention have been achieved. While only certain embodiments have been set forth, alternative embodiments and various modifications will be apparent from the above description to those skilled in the art and are considered equivalent and within the spirit and scope of the invention.

Having described the invention, what is claimed is:

1. A diesel fuel composition comprising from about 85 to about 95 weight percent of dimethyl ether, from 1 to about 20 weight percent of water, and from about 1 to about 20 weight percent of methanol, wherein the lowest concentration of methanol in weight percent, min. meth. conc., that is permitted in the diesel fuel composition containing a given water concentration in weight percent, water conc., is defined by the relationship $$0 \leqq \text{min. meth. conc.} \geqq 0.5\ (\text{water conc.}) - 2.6$$

and the largest concentration of methanol in weight percent, max. meth. conc., that is permitted in the diesel fuel containing a given water concentration in weight percent is defined by the relationship $$\text{max. meth. conc.} \leqq 20 - 0.6.$$

2. The diesel fuel composition of claim 1 comprising additionally at least one cetane number-improving additive in a cetane number-improving concentration.

3. The diesel fuel composition of claim 1 comprising from about 85 to about 93 weight percent of dimethyl ether.

4. The diesel fuel composition of claim 2 comprising from about 0.01 to about 3 weight percent of at least one cetane number-improving additive.

5. The diesel fuel composition of claim 1 comprising from about 2 to about 10 weight percent of methanol.

6. The diesel fuel composition of claim 4 comprising from about 0.05 to about 1 weight percent of at least one cetane number-improving additive.

7. The diesel fuel composition of claim 1 comprising from about 2 to about 20 weight percent of water.

8. The diesel fuel composition of claim 7 comprising from about 2 to about 10 weight percent of water.

9. The diesel fuel composition of claim 1 comprising from about 2 to about 20 weight percent of water.

10. The diesel fuel composition of claim 3 comprising from about 2 to about 10 weight percent of methanol and from about 2 to about 10 weight percent of water.

11. The diesel fuel composition of claim 1 comprising additionally up to 50 weight percent of a conventional hydrocarbon diesel fuel.

12. The diesel fuel composition of claim 1 comprising additionally up to 50 weight percent of a biodiesel fuel derived from plants or vegetables.

* * * * *

UNITED STATES PATENT AND TRADEMARK OFFICE

CERTIFICATE OF CORRECTION

PATENT NO. : 6,270,541 B1 
DATED : August 7, 2001
INVENTOR(S) : Arunabha Basu, Theodore H. Fleisch, Christopher I. McCarthy, Svend-Erik Mikkelsen, Carl A. Udovich It is certified that error appears in the above-identified patent and that said Letters Patent is hereby corrected as shown below:

Column 1,
Line 4, "Aug. 12, 1994 now abandond." should read "Aug. 12, 1994, now abandoned."
Line 67, "mixtures of dimethylether and" should read -- mixtures of dimethyl ether and --.

Column 4,
Line 20, This line should be indented.

Column 5,
Line 24, "0.03gm/bhp hr, and" should read -- 0.03gm/bhp-hr, and --.

Column 6,
Line 14, "20-0.6." should read -- 20-0.6 (water conc.)."

Signed and Sealed this

Twenty-sixth Day of February, 2002

*Attest:*

*Attesting Officer*

JAMES E. ROGAN
*Director of the United States Patent and Trademark Office*